US011001475B2

(12) United States Patent
Chen

(10) Patent No.: US 11,001,475 B2
(45) Date of Patent: May 11, 2021

(54) APARTMENT STAIRCASE AUTOMATIC LIFT

(71) Applicant: Cheng-Chung Chen, Taipei (TW)

(72) Inventor: Cheng-Chung Chen, Taipei (TW)

( * ) Notice: Subject to any disclaimer, the term of this patent is extended or adjusted under 35 U.S.C. 154(b) by 334 days.

(21) Appl. No.: 16/234,571

(22) Filed: Dec. 28, 2018

(65) Prior Publication Data

US 2020/0207584 A1 Jul. 2, 2020

(51) Int. Cl.
*B66B 9/08* (2006.01)
*B66B 1/30* (2006.01)

(52) U.S. Cl.
CPC ..... *B66B 9/08* (2013.01); *B66B 1/30* (2013.01); *B66B 9/083* (2013.01); *B66B 9/0846* (2013.01)

(58) Field of Classification Search
CPC .. B66B 9/08; B66B 1/30; B66B 9/083; B66B 9/0846
See application file for complete search history.

(56) References Cited

U.S. PATENT DOCUMENTS 2,528,265 A * 10/1950 Cretors ..... B66B 9/083 187/201
2,832,436 A * 4/1958 Roberts ..... B66B 9/083 187/201
5,052,521 A * 10/1991 Wendt ..... B66B 9/083 187/202
8,146,713 B2 * 4/2012 Rosenthal ..... B66B 9/083 187/245
2001/0004033 A1 * 6/2001 Nihei ..... B66B 11/0055 187/289
2002/0098077 A1 * 7/2002 Beech ..... B66B 9/08 187/201
2006/0117984 A1 * 6/2006 Carlsen ..... B66B 9/0846 105/29.1
2015/0375965 A1 * 12/2015 Awerbuch ..... B66B 9/0815 187/201
2018/0086601 A1 * 3/2018 Okonski ..... B66B 9/08
2019/0382243 A1 * 12/2019 van Eijgen ..... B66B 5/02
2019/0388286 A1 * 12/2019 Ferlin ..... B66B 9/083
2020/0207584 A1 * 7/2020 Chen ..... B66B 1/30

FOREIGN PATENT DOCUMENTS

CN 105438927 * 1/2016
CN 106915682 * 1/2017
CN 107352355 * 1/2017

* cited by examiner

*Primary Examiner* — Michael A Riegelman
(74) *Attorney, Agent, or Firm* — Leong C. Lei

(57) ABSTRACT

An apartment staircase automatic lift, comprising a combined structure of a carrying guiding-rail, a transmission-set main-body and a driving module; wherein the transmission-set main-body is set with a carrying wheel-seat and a transmission-set carrying-shelf; wherein the transmission-set carrying-shelf is set with a foot-pedal; when a person stands on the foot-pedal, the driving module can be controlled to drive the transmission-set main-body and the foot-pedal to move back and forth along the carrying guiding-rail between the upper and lower ends of the carrying guiding-rail; thereby helping the person to go up and down the staircase. The overall structure has the advantages of low cost, easy installation and operation, and compact structure; which can improve the defects of the conventional staircase-lift seat including the large volume size, occupying large staircase space, and being inconvenient to be arranged in a general apartment staircase.

10 Claims, 9 Drawing Sheets

APARTMENT STAIRCASE AUTOMATIC LIFT

TECHNICAL FIELD OF THE INVENTION

The present invention relates to a lift, and especially relates to a lift which can be easily installed in a staircase section of a general apartment.

DESCRIPTION OF THE PRIOR ART

At present, there is a kind of staircase-lift seat on the market, which mainly arranges the guiding-rail along the staircase, and arranges the seat on the guiding-rail; it can use the seat to ride the people and transfer up and down the staircase. These types of seats are large in size, occupy a large installation space, have a complicated seat structure, and are difficult to reduce in cost; and are usually provided for installation in an indoor staircase of a single independent household.

However, the public staircase of the apartment is for public use. If the above-mentioned staircase-lift seat is installed, in the case of a large seat, it is bound to occupy the staircase space where can be used for people to walk; which will cause the problems that the staircase space is narrow and is inconvenient for people to walk, so that the conventional staircase-lift seat is not suitable for the situation of the staircase in the general apartment.

SUMMARY OF THE INVENTION

According to the present invention, an apartment staircase automatic lift comprises a combined structure of a carrying guiding-rail, a transmission-set main-body and a driving module; wherein the carrying guiding-rail has an upper end and a lower end, and the transmission-set main-body is set with a carrying wheel-seat and a transmission-set carrying-shelf; wherein the bottom of the transmission-set carrying-shelf is set with a foot-pedal, and the driving module is connected with the transmission-set main-body; when a person stands on the foot-pedal, the driving module can be controlled; wherein the driving module is electrically connected with a speed sensing component to detect the operating speed; such that the transmission-set main-body and the foot-pedal to move back and forth along the carrying guiding-rail between the upper and lower ends of the carrying guiding-rail; thereby helping the person to go up and down the staircase.

The overall structure has the advantages of low cost, easy installation and operation, and compact structure; which can improve the defects of the conventional staircase-lift seat including the large volume size, occupying large staircase space, and being inconvenient to be arranged in a general apartment staircase.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Please refer to FIG. 1 to FIG. 6, the apartment staircase automatic lift of the present invention comprises a combined structure of a carrying guiding-rail A, a transmission-set main-body D and a driving module H; wherein the carrying guiding-rail A is located along the direction of the apartment staircase P, and is set at the position of the apartment wall Q near the side of the staircase P, and the two ends of the carrying guiding-rail A respectively have an upper end and a lower end; wherein the carrying guiding-rail A is set with a guiding slot open upward, and the two ends of the guiding slot respectively extend to the upper end and the lower end of the carrying guiding-rail A.

Please refer to FIG. 3 to FIG. 6, wherein the transmission-set main-body D is set with a transmission-set main-body base-plate D1, and the bottom of the transmission-set main-body base-plate D1 is set with a carrying wheel-seat D4; wherein a transmission-set carrying-shelf E is set outside the transmission-set main-body base-plate D1, and the carrying wheel-seat D4 comprises a carrying rolling-wheel D5; wherein the carrying rolling-wheel D5 can roll along the guiding slot of the carrying guiding-rail A, so that the transmission-set main-body D is slid and set on the carrying guiding-rail A by the carrying wheel-seat D4.

Figure 5:
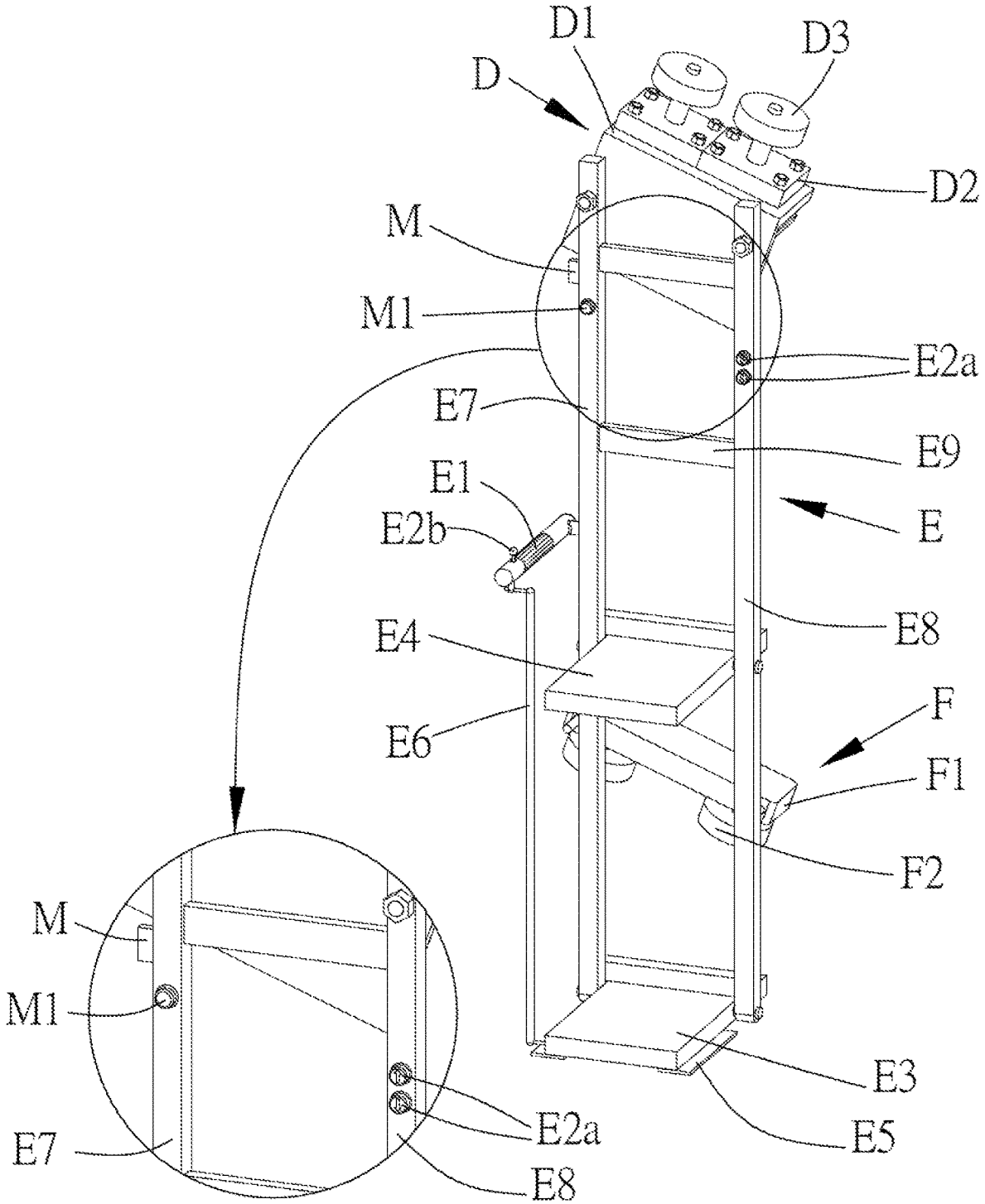
FIG. 5 is stereoscopic diagram of another viewing angle of the transmission-set main-body and the transmission-set carrying-shelf of FIG. 1.
Figure 6:
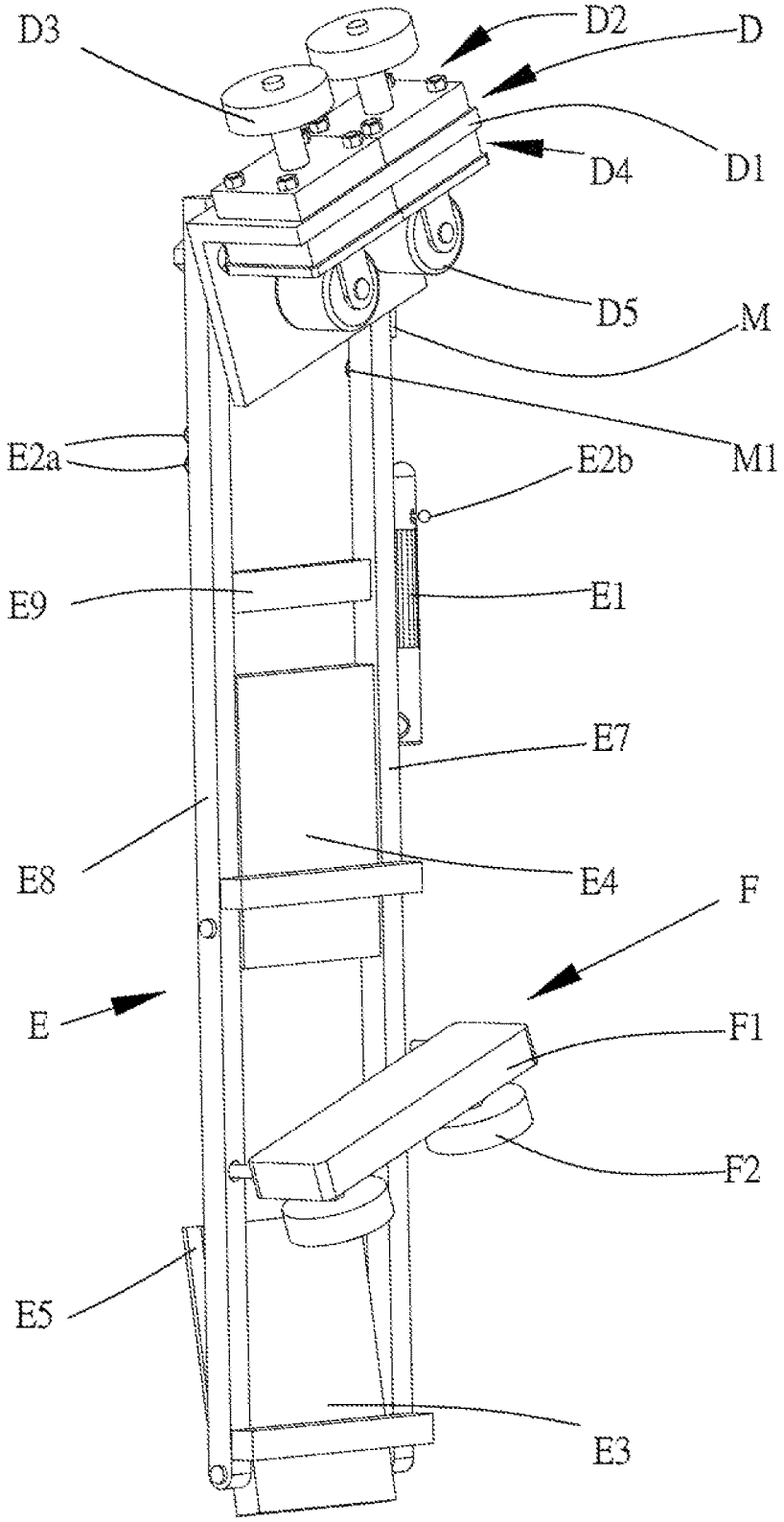
FIG. 6 is a stereoscopic diagram of another viewing angle of FIG. 5.
Figure 8:
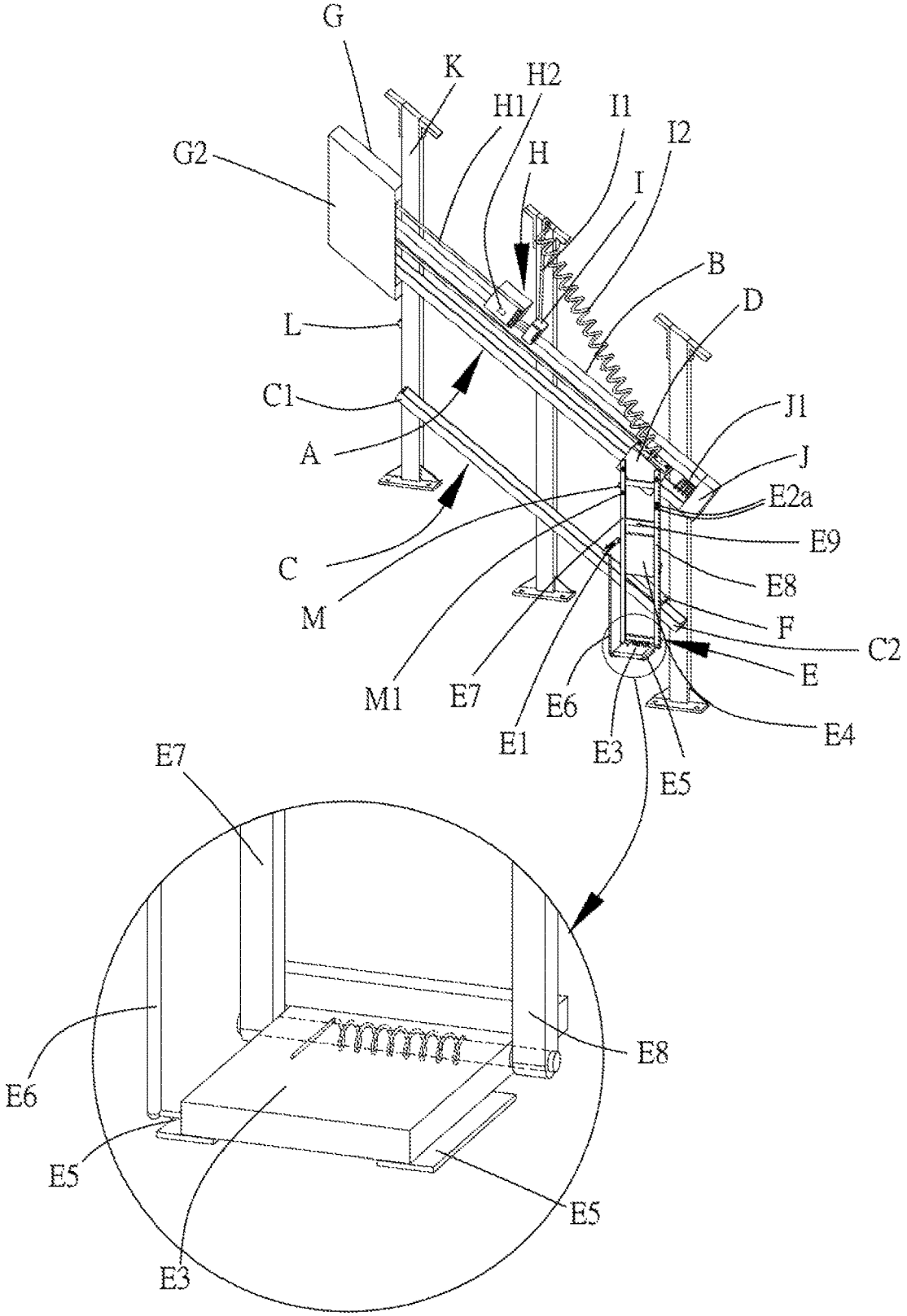
FIG. 8 is a stereoscopic diagram of the other using state of FIG 1.

Please refer to FIG. 5 and FIG. 6, the transmission group carrier E comprises a carrying-shelf left-column E7, a carrying-shelf right-column E8, and at least one carrying-shelf crossbeam E9 connected between the carrying-shelf left-column E7 and the carrying-shelf right-column E8; wherein the carrying-shelf left-column E7 and the carrying-shelf right-column E8 extend downward from the transmission-set main-body D to form a top end, a bottom end, and a middle portion positioned between the top end and the bottom end; wherein the top ends of the carrying-shelf left-column and the carrying-shelf right-column are combined on the outer side of the base-plate of the main-body; wherein the bottoms of the carrying-shelf left-column E7 and the carrying-shelf right-column E8 are set with a foldable foot-pedal E3, so that the foot-pedal E3 can be folded into the position between the carrying-shelf left-column E7 and the carrying-shelf right-column E8; wherein the foot-pedal E3 can also be unfolded to a state which is perpendicular to the transmission-set carrying-shelf E (as shown in FIG. 5); wherein the middle portions of the carrying-shelf left-column E7 and the carrying-shelf right-column E8 are set with a foldable rod-shaped control handle E1, so that the control handle E1 can be parallelly folded to and be closely against the carrying-shelf left-column E7; and can also be unfolded to a state which is perpendicular to the transmission-set carrying-shelf E; wherein the control handle E1 and the foot-pedal E3 can be jointly moved with each other via a connecting rod E6; moreover, a torsion spring or a weighting-block can be arranged between the bottom of the carrying-shelf left-column E7 and the bottom of the carrying-shelf right-column E8 and the foot-pedal E3 (as shown in FIG. 8); wherein the torsion spring or the weighting-block can normally drive the foot-pedal E3 to be folded into between the carrying-shelf left-column E7 and the carrying-shelf right-column E8.

The driving module H comprises a driving module controller I, at least one pulley assembly G, and a steel-cable H1; wherein the driving module H can be set as a hoist with a brake function, and the driving module H is electrically connected with a speed sensing component H2 to detect the operating speed; when the operating speed of the driving module H is abnormal (the abnormality includes power-off, cable H1 breakage, etc.), the brake function is started; wherein the pulley assembly G is set with two pulley supporting-plates G2, a plurality of pulley supporting-plate shells G3 to combine the two pulley supporting-plates G2, and at least one pulley G1 set between the two pulley supporting-plates G2; wherein the pulley assembly G is fixed and set on the upper end of the carrying guiding-rail A by two pulley supporting-plates G2, and the middle portion of the steel-cable H1 is wound around the pulley G1; wherein the two ends of the steel-cable H1 are respectively connected with the driving module H and the transmission-set main-body D or the carrying wheel-seat D4, and the driving module controller I is electrically connected with the driving module H.

wherein the transmission-set carrying-shelf E is set with an elevator upper/lower switch (a) E2*a* for controlling the driving module H or an elevator upper/lower switch (b) E2*b* for controlling the driving module H; wherein the elevator upper/lower switch (b) E2*b* (as shown in FIG. 5) is set on the control handle E1 of the transmission-set carrying-shelf E, and the elevator upper/lower switch (a) E2*a* and the elevator upper/lower switch (b) E2*b* can operate the driving module H and the driving module controller I in a wireless or wired manner to control the driving module controller I to control the driving module H to drive the transmission-set main-body D via the steel-cable H1; thereby driving the transmission-set main-body D and the foot-pedal E3 to move back and forth between the upper end and the lower end of the carrying guiding-rail A along the carrying guiding-rail A; and the driving module controller I is electrically connected with the transmission-set main-body D via an electrical-wire I1 and a spiral extendable electrical-wire I2; wherein the driving module controller I is electrically connected with a lift one-way up button L, a power source restart switch M, and a power emergency cut-off switch M1; wherein the elevator lift one-way up button L is set at a position below the upper end of the carrying guiding-rail A, and the power restart switch M and the power emergency cut-off switch M1 are set on the carrying-shelf left-column E7 of the transmission-set carrying-shelf E; and the elevator up/down switch (a) E2*a,* the elevator up/down switch (b) E2*b,* the power restart switch M, and the power emergency cut-off switch M1 are respectively electrically connected with the driving module controller I via the electrical-wire I1 and the spiral extendable electric electrical-wire I2.

Figure 3:
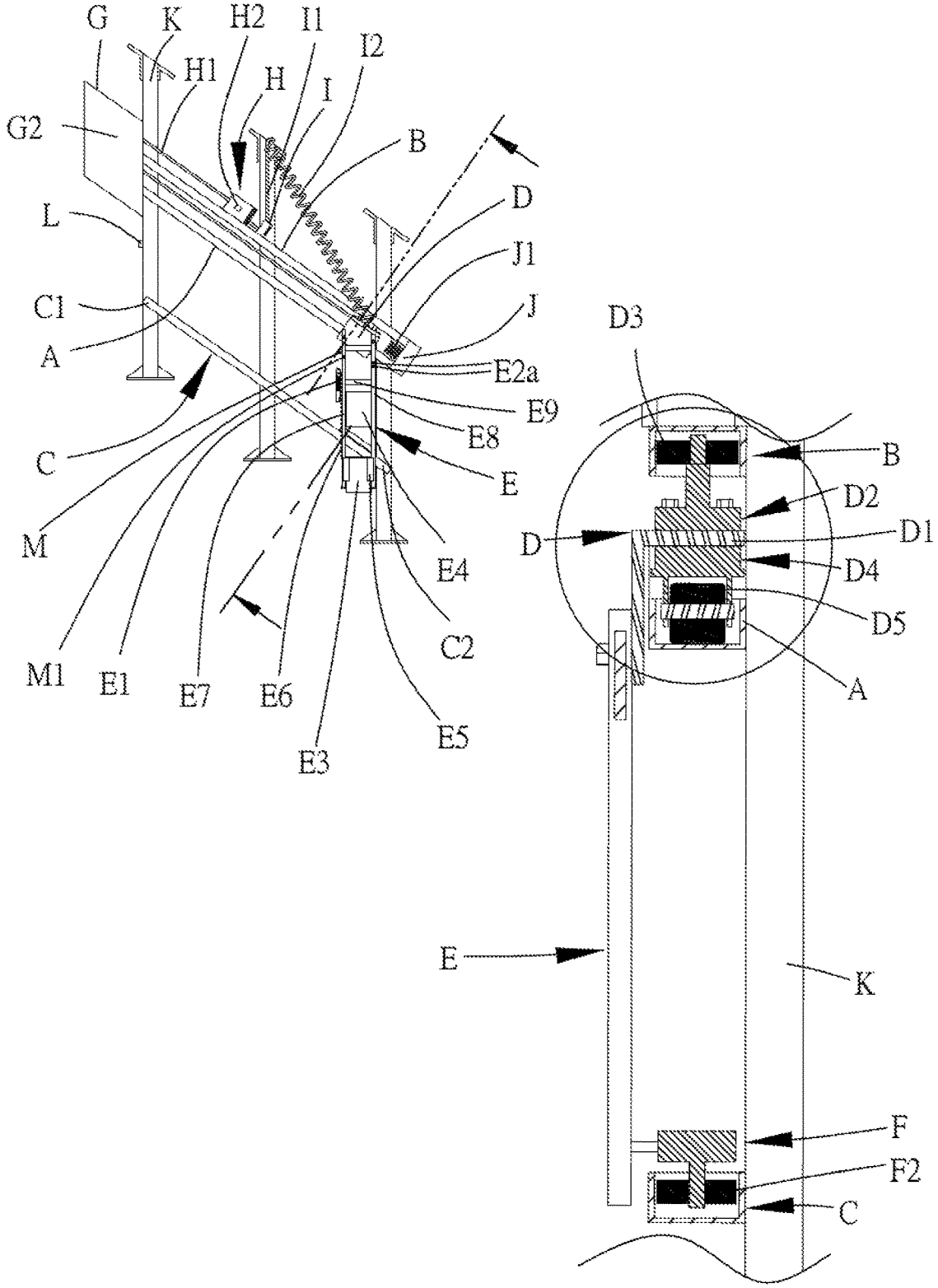
FIG. 3 is a partial cross-sectional view of FIG. 2.
Figure 4:
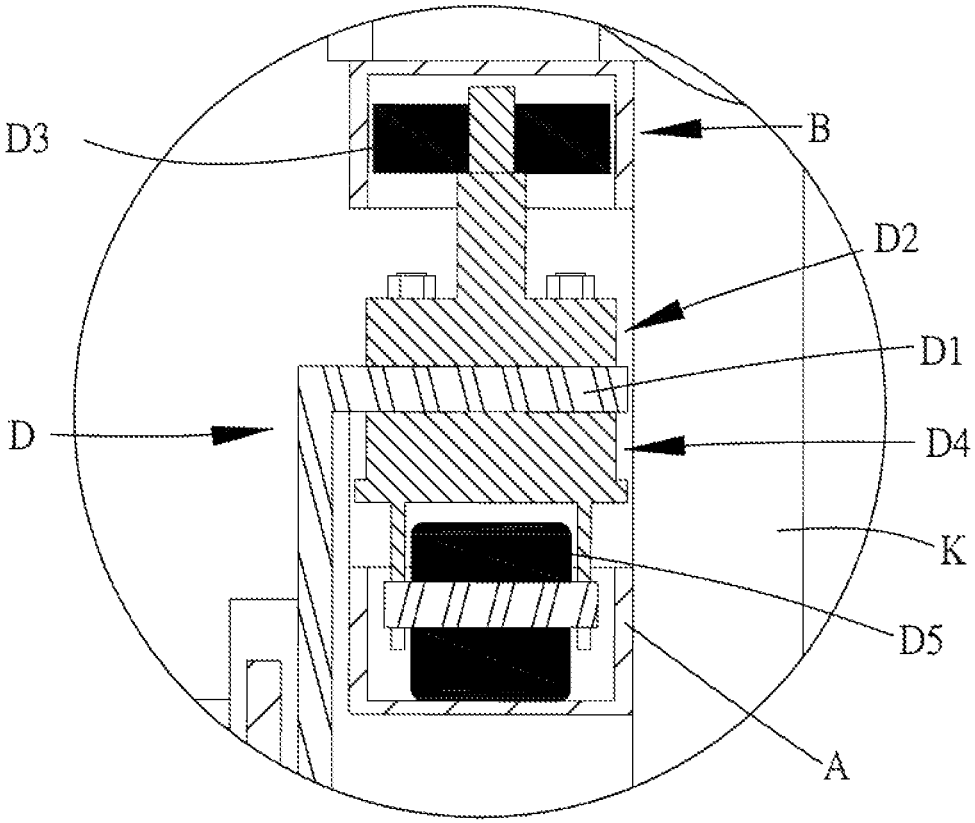
FIG. 4 is a partial enlarged cross-sectional view of FIG. 3.

Please refer to FIG. 3 and FIG. 4, in a practical embodiment, a lower guiding-rail C is set in parallel below the carrying guiding-rail A; wherein the lower guiding-rail C has an upper end and a lower end, and the lower guiding-rail C is set with a guiding slot open upward, and both ends of the guiding slot are respectively extended to the upper end and the lower end of the lower guiding-rail C; wherein the bottom end of the transmission-set carrying-shelf E is set with a lower guiding-wheel module F of the lower guiding-rail, and the guiding-wheel module F of the lower guiding-rail C comprises a lower guiding wheel-seat F1 and a lower guiding wheel F2 pivotally set at the bottom of the lower guiding wheel-seat F1; wherein the lower guiding-wheel F2 can be rolled along the guiding groove of the lower guiding-rail C, so that the bottom end of the transmission-set carrying-shelf E can be slid and set on the lower guiding-rail C by the guiding-wheel module F of the lower guiding-rail C; and an upper-end blocking-sheet C1 of the lower guiding-rail C is set on the upper end of the lower guiding-rail C; wherein the lower end of the lower guiding-rail C is set with a lower-end blocking-sheet C2 of the lower guiding-rail C, which the upper-end blocking sheet C1 and the lower-end blocking-sheet C2 of the lower guiding-rail C can restrain the lower guiding-wheel F2 rolling in the guiding groove of the lower guiding-rail C; moreover, an upper guiding-rail B is set in parallel above the carrying guiding-rail A; wherein the driving module H and the driving module controller I can be fixed on the upper guiding-rail B; and the upper guiding-rail B has an upper end and a lower end; wherein the upper guiding-rail B is set with a guiding groove open to the lower side, and both ends of the guiding groove respectively extend to the upper end and the lower end of the upper guiding-rail B; wherein an upper guiding wheel-seat D2 is set on the top of the transmission-set main-body base-plate D1, and is located above the carrying wheel-seat D4; wherein the upper guiding wheel-seat D2 is pivotally set with at least one upper guiding-wheel D3, which the upper guiding-wheel D3 can be rolled along the guiding groove of the upper guiding-rail B, so that the transmission-set main-body D is slid and set on the upper guiding-rail B by the upper guiding wheel-seat D2; in this way, the transmission-set main-body D and the transmission-set carrying-shelf E can be supported by multiple points including the carrying wheel-seat D4, the lower guiding-wheel module F of the lower guiding-rail, and the upper guiding wheel-seat D2, etc. to slide and set at the position of the apartment wall Q near the side of the staircase P to improve the stability of the transmission-set carrying-shelf E when it is displaced up and down.

In addition, the upper end of the upper guiding-rail B is set with an upper guiding-rail blocking-sheet B1, and the upper end of the carrying guiding-rail A is set with a carrying guiding-rail blocking-sheet A1; wherein the carrying guiding-rail A and the lower end of the upper guiding-rail B are combined to form a carrying guiding-rail, a stopping-block J connected with the lower end of the upper guiding-rail B, and an impact buffer spring J1 facing towards the carrying wheel-seat D4; and, a limit switch (top) N is set at an upper end of the upper guiding-rail B, and a limit switch (bottom) O is set at a lower end of the upper guiding-rail B; wherein the upper end blocking-sheet B1 of the upper guiding-rail and the lower end stopping-block J jointing the carrying guiding-rail and the upper guiding-rail B can restrain the carrying rolling-wheel D5 rolling in the guiding groove of the carrying guiding-rail A; moreover, when the transmission-set main-body D touches the limit switch (top) N or the limit switch (bottom) O, the limit switch (top) N and the limit switch (bottom) O are controlled to stop the operation of the driving module H, and the impact buffer spring J1 can generate an anti-collision buffering effect on the transmission-set main-body D and the carrying wheel-seat D4.

In another embodiment, a plurality of elevator structural columns K can also be set at a position of one side of the staircase P near the apartment wall Q; wherein the above-mentioned carrying guiding-rail A, lower guiding-rail C and guiding-rail B can be fixed together on the elevator structural columns K, and the elevator one-way up button L can be set on the elevator structural column K at the upper end of the staircase P.

Figure 1:
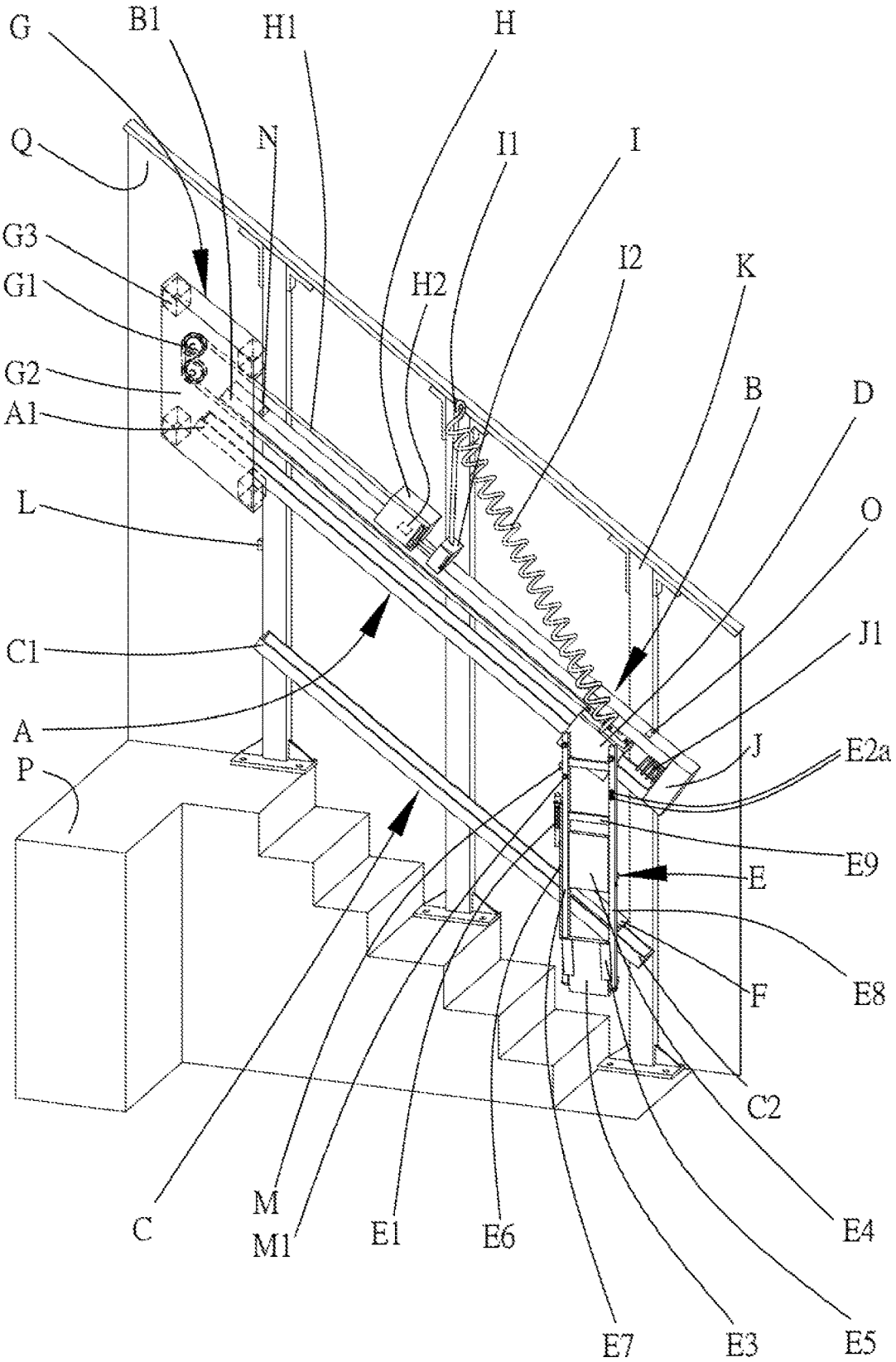
FIG. 1 is a stereoscopic diagram of the present invention.
Figure 2:
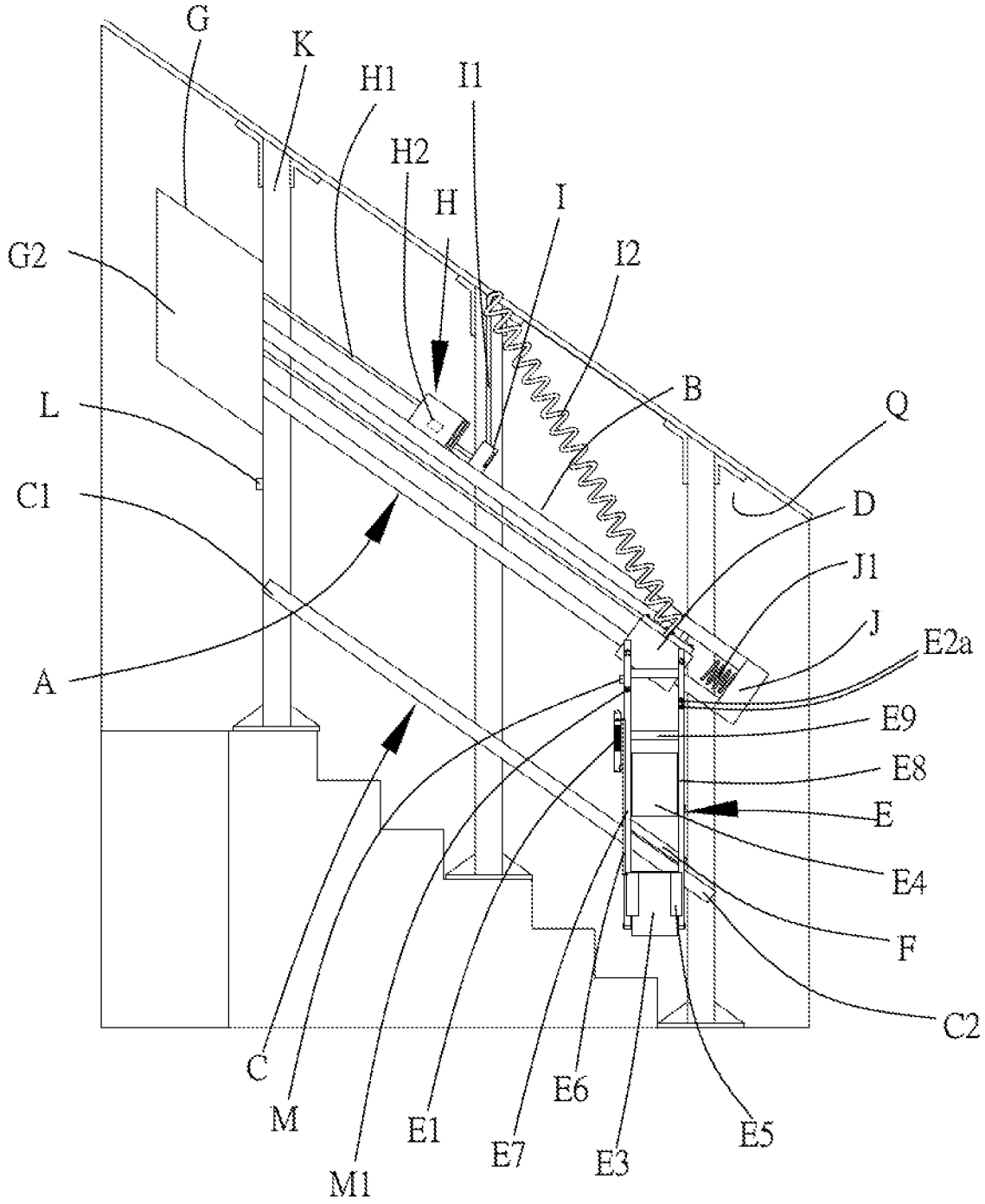
FIG. 2 is a front view of FIG. 1.

Please refer to FIG. 1 and FIG. 2, when the lift is not in use, the transmission-set carrying-shelf E is stopped at the bottom of the elevator, and the foot-pedal E3 and the control handle E1 are automatically folded and placed against the transmission-set carrying-shelf E, which can occupy no staircase P space; at this time, the elevator up/down switch (a) E2*a* or the elevator up/down switch (b) E2*b* cannot control the operation of the driving module H (the control handle E1 must be pulled down to be perpendicular to the transmission-set carrying-shelf E, then the system circuit will operate).

Figure 7:
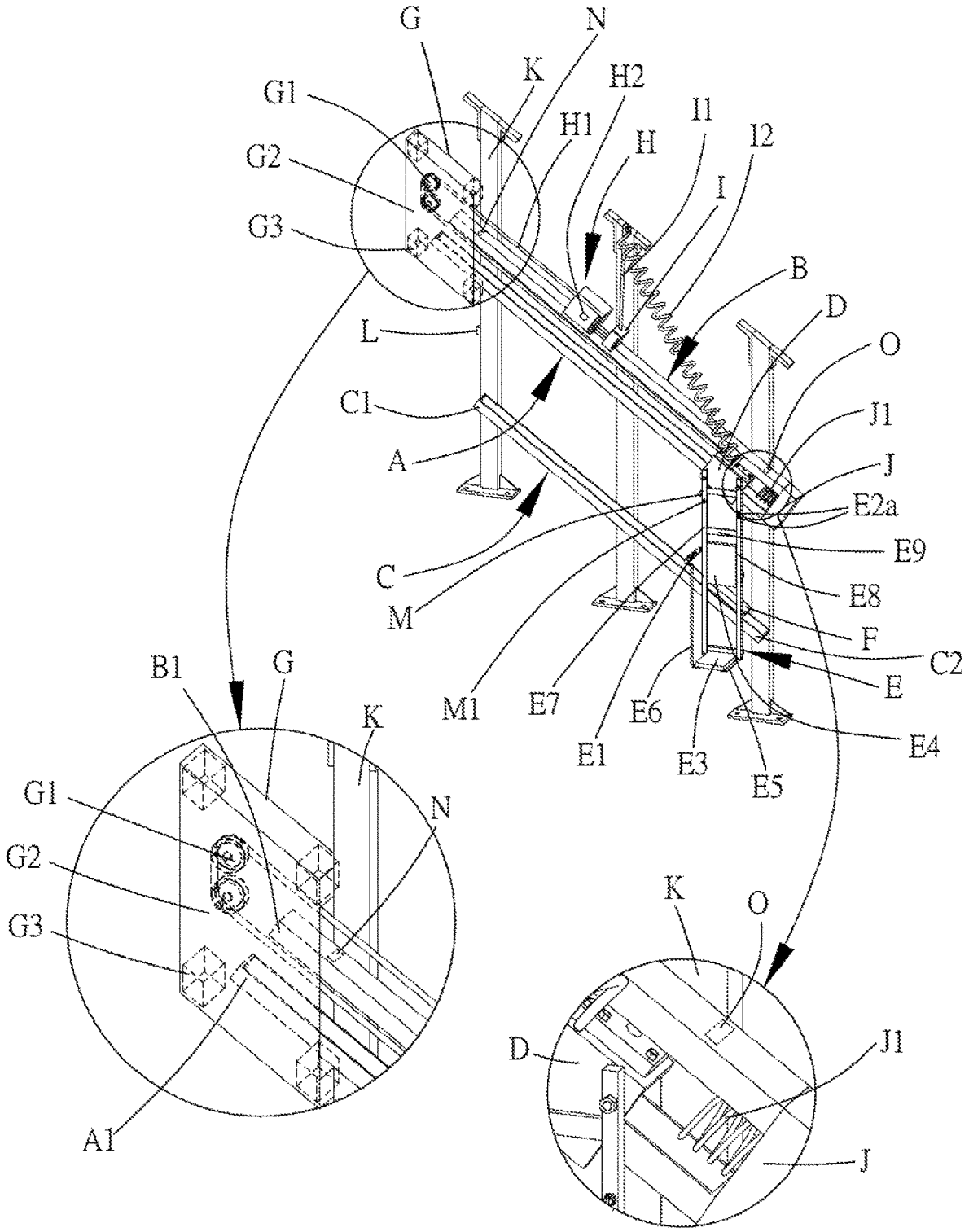
FIG. 7 is a stereoscopic diagram of the using state of FIG. 1.
Figure 9:
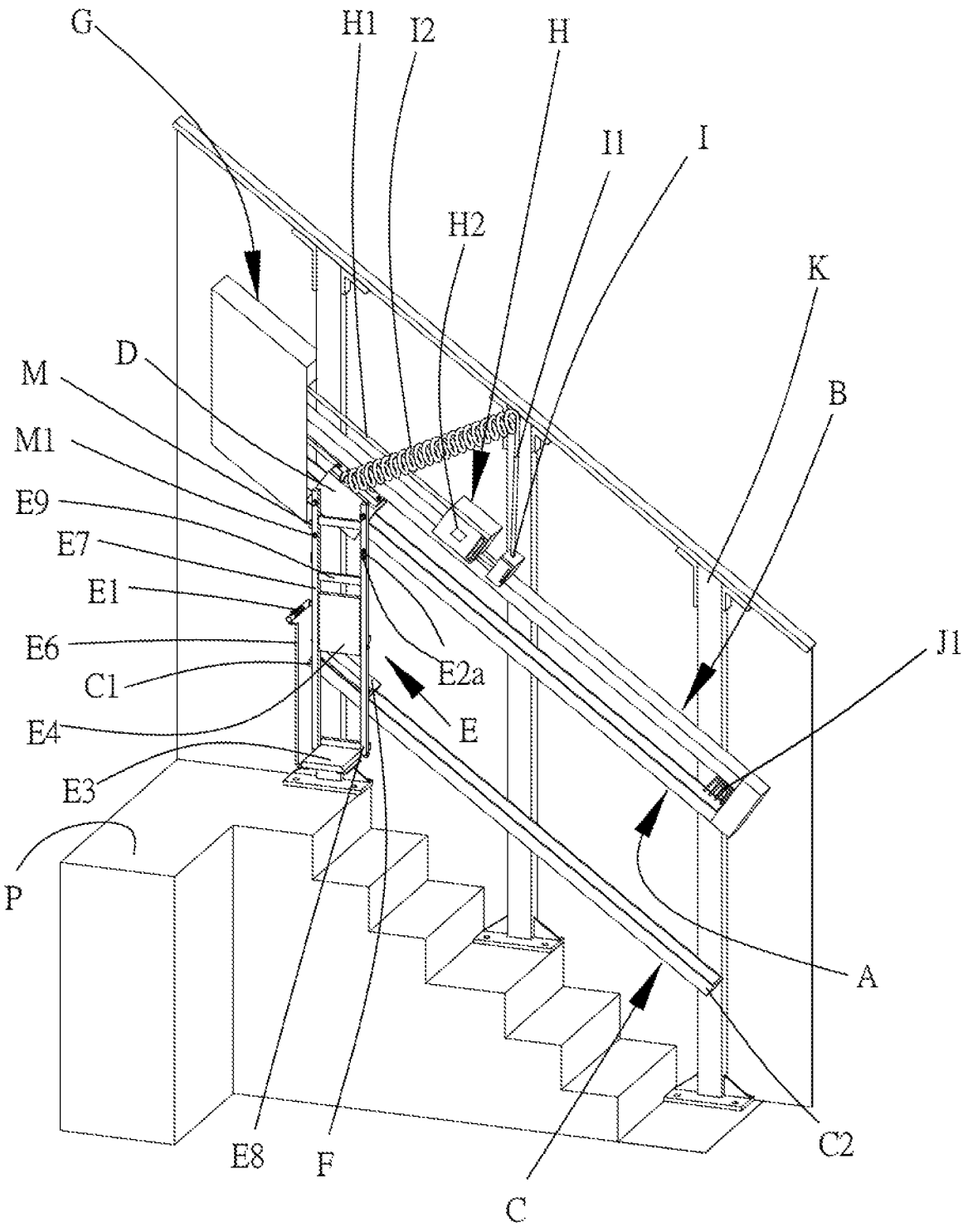
FIG. 9 is a stereoscopic diagram of another using state of FIG. 1.

Please refer to FIG. 5, FIG. 6, and FIG. 7; when the lift is in use, the control handle E1 can be unfolded outside the transmission-set carrying-shelf E, so that the control handle E1 can drive the foot-pedal E3 to unfold towards the outside of the transmission-set carrying-shelf E via the connecting rod E6; when a person stands on the foot-pedal E3, the hand can be supported on the control handle E1, which the driving module H is controlled by the elevator up/down switch (a) E2*a* or the elevator up/down switch (b) E2*b*, and the driving module H can drive the transmission-set main-body D and the foot-pedal E3 to move up along the carrying guiding-rail A to the upper end of the carrying guiding-rail A (as shown in FIG. 9); wherein the driving module H can also be driven to move the transmission-set main-body D and the foot-pedal E3 downward along the carrying guiding-rail A to the lower end of the carrying guiding-rail A, thereby transferring and helping the person to go up and down the staircase P; during the movement of the foot-pedal E3 up and down, if the elevator up/down switch (a) E2*a* or the elevator up/down switch (b) E2*b* is released, the foot-pedal E3 stops moving; at this time, if the elevator up/down switch (a) E2*a* or the elevator up/down switch (b) E2*b* is operated again, the foot-pedal E3 can be driven to continue to move up or down until the transmission-set main-body D touches the limit switch (top) N or the limit switch (bottom) O, then the foot-pedal E3 will stop moving; when the person reaches the upper end of the staircase, leaving the foot-pedal E3, the control handle E1 and the foot-pedal E3 will be automatically homing to an upright state; and after 3 to 5 seconds, the transmission-set main-body D and the transmission-set carrying-shelf E will automatically move down until reaching the bottom of the lift, and then will automatically stop; during this period, the power emergency cut-off switch M1 can be operated to urgently stop the movement of the transmission-set main-body D and the transmission-set carrying-shelf E, and the power supply restart switch M can be operated to move the transmission-set main-body D and the transmission-set carrying-shelf E; if the person wants to go down the staircase at the upper end of the staircase P, the elevator one-way up button L can also be operated to drive the transmission-set mainbody D and the transmission-set carrying-shelf E up to the upper end of the staircase P, thereby transferring and helping the person to go down the staircase P.

The design major point of the present invention is the lowest influence on the staircase space, wherein the foot-pedal E3 and the carrying-plate E4 are both in the form of a flat plate and are foldable, which can greatly reduce the volume, save the space, and is convenient to be arranged in a general apartment staircase P; which the overall structure has the advantages of low cost, easy installation and operation, and compact structure.

In another practical embodiment, the carrying-shelf left-column E7 and the middle portion of the carrying-shelf right-column E8 are set with a foldable carrying-plate E4, so that the carrying-plate E4 can be folded into the carrying-shelf left-column E7 and the carrying-shelf right-column E8; wherein the carrying-plate E4 can also be unfolded to the state being perpendicular to the transmission-set carrying-shelf E; when the carrying-plate E4 is unfolded outwardly between the carrying-shelf left-column E7 and the carrying-shelf right-column E8, the carrying-plate E4 can be perpendicular to the transmission-set carrying-shelf E, and the carrying-plate E4 can be used for riding the person.

Please refer to FIG. 5, in this embodiment, the foot-pedal E3 has a front end and a rear end; wherein the front end of the foot-pedal E3 faces the upper end of the carrying guiding-rail A, and the rear end of the foot-pedal E3 faces the lower end of the carrying guiding-rail A; wherein an collision-preventing sensor E5 is set at the front end or the rear end of the foot-pedal E3; wherein the collision-preventing sensor E5 can be a touch switch or a light sensing group; when the transmission-set carrying-shelf E and the foot-pedal E3 are displaced up and down along the staircase P, if the collision-preventing sensor E5 at the front end or the rear end of the foot pedal E3 touches the child, other persons, pets or articles; the collision-preventing sensor E5 can control the driving module H in a wired or wireless manner, and the operation of the driving module H is stopped urgently; so that transmission-set carrying-shelf E and the foot-pedal E3 stop moving immediately to avoid injury to the child, other persons, pets or articles; when the power supply restart switch M is operated, and the elevator up/down switch (a) E2*a* or the elevator up/down switch (b) E2*b* are operated under the condition that the control handle E1 is unfolded outward, the transmission-set main-body D and the foot-pedal E3 can be re-driven to continue moving up or down.

I claim:

1. An apartment staircase automatic lift, which comprises:

a carrying guiding-rail having an upper end and a lower end;

a transmission-set main-body set with a wheel-seat and a transmission-set carrying-shelf; wherein the transmission-set main-body is slid and set on the carrying guiding-rail by the carrying wheel-seat;

wherein the transmission-set carrying-shelf extends downward from the transmission-set main-body to form a top end, a bottom end, and a middle portion positioned between the top end and the bottom end;

wherein the top end of the transmission-set carrying-shelf is combined to form the transmission-set main-body;

wherein the bottom end of the transmission-set carrying-shelf is set with a foot-pedal;

wherein the middle portion of the transmission-set carrying-shelf is set with a control handle; and a driving module connected with the transmission-set main-body; wherein the driving module drives the transmission-set main-body and the foot-pedal to move back and forth between the upper end and the lower end of the carrying guiding-rail along the carrying guiding-rail.

2. The apartment staircase automatic lift according to claim 1, wherein the driving module is a hoist with a brake function, and the driving module is electrically connected with a speed sensing component to detect the operating speed.

3. The apartment staircase automatic lift according to claim 1, wherein the transmission-set carrying-shelf is set with at least one of the elevator upper/lower switch (a) and the elevator upper/lower switch (b) to control the driving module.

4. The apartment staircase automatic lift according to claim 3, wherein the transmission-set carrying-shelf comprises a carrying-shelf left-column, a carrying-shelf right-column, and at least one carrying-shelf crossbeam connected between the carrying-shelf left-column and the carrying-shelf right-column, wherein the elevator upper/lower switch (b) is set on the control handle.

5. The apartment staircase automatic lift according to claim 4, wherein the elevator upper/lower switch (b) is set to at least one of a rocker switch and an up/down independent button switch.

6. The apartment staircase automatic lift according to claim 1, wherein the foot-pedal is a foldable foot-pedal, and the control handle is a foldable control handle; wherein the control handle and the foot-pedal is jointly moved with each other via a connecting rod.

7. The apartment staircase automatic lift according to claim 1, wherein the foot-pedal has a front end facing the upper end of the carrying guiding-rail and a rear end facing the lower end of the carrying guiding-rail; wherein the front end and the rear end are both set with an collision-preventing sensor capable of urgently stopping the operation of the driving module;

wherein the middle portion of the transmission-set carrying-shelf is set with a foldable carrying-plate, and the carrying guiding-rail is set with a guiding groove open to the upper side, and both ends of the guiding groove respectively extend to the upper end and the lower end of the carrying guiding-rail;

wherein the carrying wheel-seat comprises a carrying rolling-wheel capable of rolling along the guiding slot of the carrying guiding-rail.

8. The apartment staircase automatic lift according to claim 1, wherein a lower guiding-rail having an upper end and a lower end is set in parallel below the carrying guiding-rail, wherein the bottom end of the transmission-set carrying-shelf is set with a guiding-wheel module of the lower guiding-rail, and the bottom end of the transmission-set carrying-shelf is slid and set on the lower guiding-rail via the guiding-wheel module of the lower guiding-rail;

wherein the lower guiding-rail is set with a guiding slot open upward, and both ends of the guiding slot are respectively extended to the upper end and the lower end of the lower guiding-rail;

wherein the guiding-wheel module of the lower guiding-rail comprises a lower guiding wheel-seat and a lower guiding-wheel pivotally set at the bottom of the lower guiding wheel-seat; and the lower guiding-wheel rolls along the guiding groove of the lower guiding-rail;

wherein an upper-end blocking-sheet of the lower guiding-rail is set on the upper end of the lower guiding-rail, and the lower end of the lower guiding-rail is set with a lower-end blocker sheet of the lower guiding-rail.

9. The apartment staircase automatic lift according to claim 8, wherein an upper guiding-rail having an upper end and a lower set parallel above the carrying guiding-rail;

wherein the transmission-set main-body is set with an upper guiding wheel-seat which is located above the carrying wheel-seat; wherein the transmission-set main-body is slid and set on the upper guiding-rail by the upper guiding wheel-seat;

wherein the upper guiding-rail is set with a guiding groove open to the lower side, and both ends of the guiding groove respectively extend to the upper end and the lower end of the upper guiding-rail;

wherein the upper guiding wheel-seat is pivotally set with an upper guiding-wheel, which the upper guiding wheel rolls along the guiding groove of the upper guiding-rail; wherein the upper guiding-rail is set with an upper guiding-rail blocking-sheet;

wherein the carrying guiding-rail and the lower end of the upper guiding-rail are combined to form a carrying guiding-rail, a stopping-block connected with the lower end of the upper guiding-rail, and an impact buffer spring facing towards the carrying wheel-seat;

wherein a limit switch (top) is set at an upper end of the upper guiding-rail, and a limit switch (bottom) is set at a lower end of the upper guiding-rail; wherein the carrying guiding-rail, the lower guiding-rail, and the upper guiding-rail are fixed together on a plurality of elevator structural columns.

10. The apartment staircase automatic lift according to claim 1, wherein the driving module comprises a driving module controller, at least one pulley assembly, and a steel-cable;

wherein the pulley assembly is set with two pulley supporting-plates, a plurality of pulley supporting-plate shelfs to combine the two pulley supporting plates, and at least one pulley set between the two pulley supporting plates;

wherein the pulley assembly is set outside the upper end of the carrying guiding-rail, and line middle portion of the steel-cable is wound around the pulley;

wherein the two ends of the steel-cable are respectively connected with the driving module and the transmission-set main-body, and the driving module controller can control the driving module to drive the transmission-set main-body via the steel-cable;

wherein the driving module controller is electrically connected with the transmission-set main-body via an electrical-wire and a spiral extendable electrical-wire; wherein the driving module controller is electrically connected with a lift one-way up button, a power source restart switch, and a power emergency cut-off switch;

wherein the elevator lift one-way up button is set at a position below the upper end of the carrying guiding-rail, and the power restart switch and the power emergency cut-off switch are set on the carrying-shelf left-column of the transmission-set carry-shelf.

* * * * *